US005608178A

United States Patent [19]

Iwase

[11] Patent Number: 5,608,178

[45] Date of Patent: Mar. 4, 1997

[54] METHOD OF STORING AND EDITING PERFORMANCE DATA IN AN AUTOMATIC PERFORMANCE DEVICE

[75] Inventor: Hiroyuki Iwase, Hamamatsu, Japan

[73] Assignee: Yamaha Corporation, Japan

[21] Appl. No.: 365,156

[22] Filed: Dec. 28, 1994

[30] Foreign Application Priority Data

Dec. 29, 1993 [JP] Japan ..... 5-354315

[51] Int. Cl.[6] ..... G10H 1/00

[52] U.S. Cl. ..... 84/609

[58] Field of Search ..... 84/604–607, 609–614, 84/649–652, 634–638, 666–669

[56] References Cited

U.S. PATENT DOCUMENTS

| | | | |
|---|---|---|---|
| 4,953,438 | 9/1990 | Shibukawa | 84/609 |
| 5,085,116 | 2/1992 | Nakata et al. | 84/609 |
| 5,220,119 | 6/1993 | Shimada | 84/609 |
| 5,442,126 | 8/1995 | Tokiharu | 84/604 X |

FOREIGN PATENT DOCUMENTS 4-5996 2/1992 Japan .

*Primary Examiner*—Stanley J. Witkowski
*Attorney, Agent, or Firm*—Graham & James LLP

[57] ABSTRACT

A series of the performance data is stored in one or more blocks composing a memory block chain of a memory. The performance order of the blocks is specified by management information stored in a table. For data-inserting editing, any of the blocks available in the memory is secured as an additional block, and the management information stored in the table is rewritten in such a manner that the additional block is connected next to a specific block corresponding to a desired inserting position in the memory block chain. The performance data stored in the specific block corresponding to the desired inserting position is divided into a preceding data group located before the inserting position and into a succeeding data group located after the inserting position, and the succeeding data group is copied into the additional block. In this way, a region of the specific block which succeeds the inserting position, and a region of the additional block which precedes the storage locations for the succeeding data group become the available storage locations. Thus, available storage locations which together correspond in size exactly to a single block are created in the specific and additional blocks, and data to be inserted can be written in these available storage locations. Consequently, it is possible to eliminate the need for rewriting data of other blocks composing the memory block chain, and thus a time for the editing can be reduced.

20 Claims, 9 Drawing Sheets

| | Tr1 | Tr2 | Tr3 | Tr4 | Chord | Style |
|---|---|---|---|---|---|---|
| Song 1 | FE | 00 | FE | FE | FE | FE |
| 2 | | | | | | |
| ⋮ | | | | | | |
| 20 | FE | FE | FE | FE | FE | FE |
SONG TABLE
FIG. 2
| 00 | 01 | 02 | 03 | 04 | 05 | 06 | 07 | | 99 |
|---|---|---|---|---|---|---|---|---|---|
| 03 | FF | FE | 05 | FE | 01 | FE | FE | ···· | FE |
FILE ALLOCATION TABLE
FIG. 3
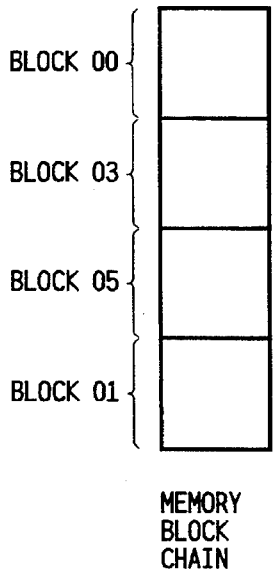
FIG. 4A
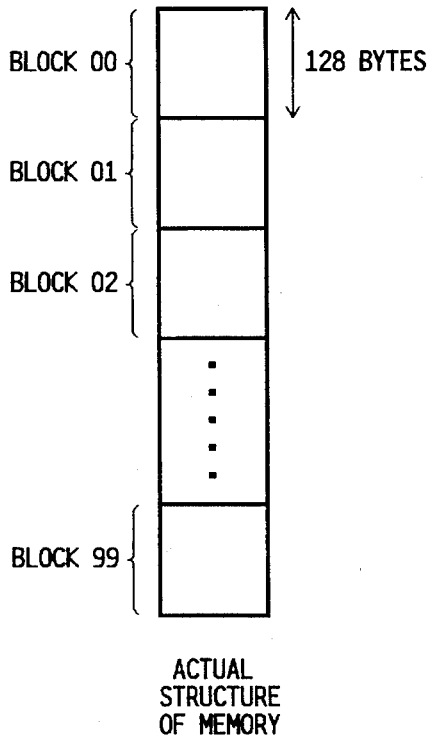
FIG. 4B

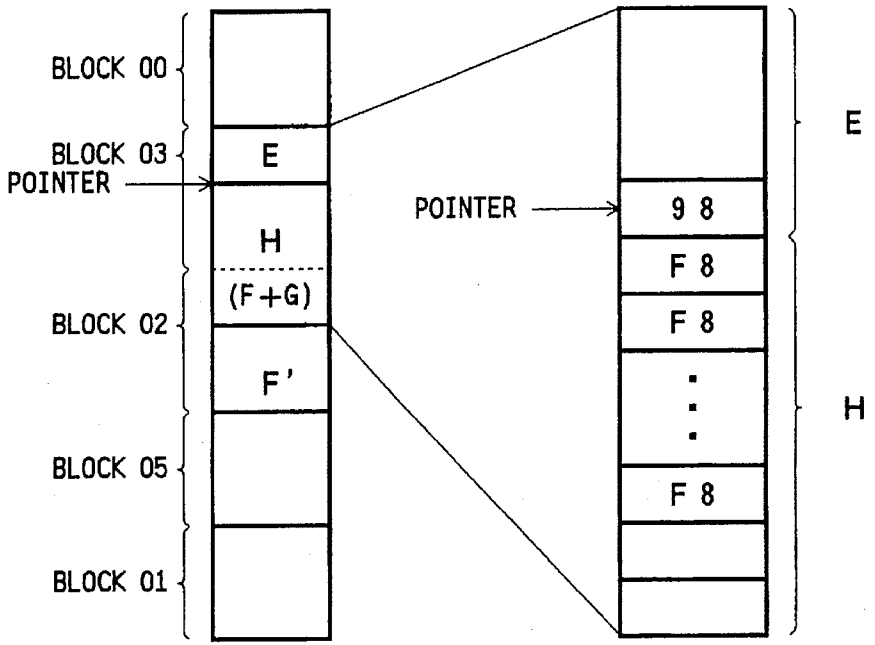
FIG. 5B
FIG. 5C
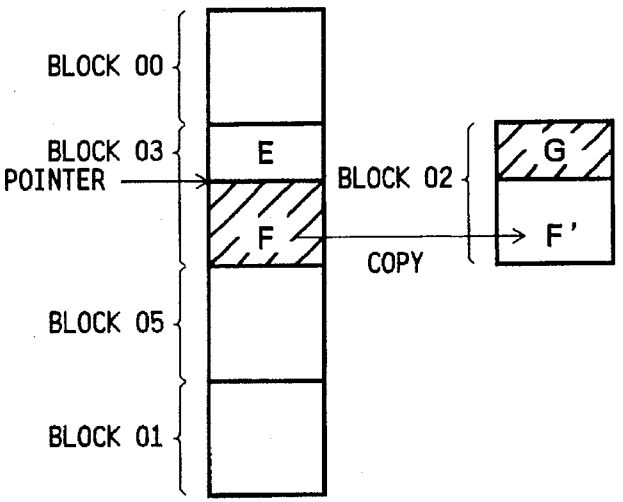
FIG. 5A

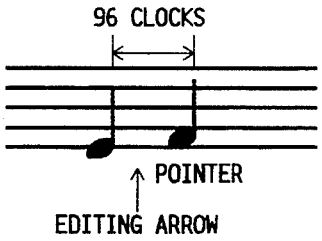
EDITING PICTURE
FIG. 8A
| | |
|---|---|
| C 0 | KEY-ON |
| 6 0 | GATE TIME(96 CLOCKS) |
| 4 0 | NOTE NO. |
| 7 F | VELOCITY |
| E 0 | DURATION (96) |
| C 0 | |
| 6 0 | |
| 4 1 | |
| 7 F | |
| E 0 | |
| | |
FIG. 8B
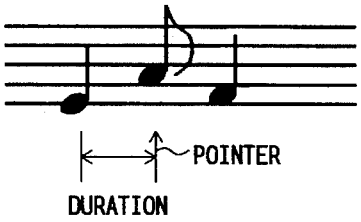
EDITING PICTURE
FIG. 9A
| | | |
|---|---|---|
| | C 0 | (96 CLOCKS) NOTE DATA |
| | 6 0 | |
| | 4 0 | |
| | 7 F | |
| | B 0 | |
| | C 0 | INSERTED NOTE DATA |
| | 4 8 | |
| | 4 5 | |
| | 7 F | |
| POINTER → | B 0 | |
| NTA → | F 8 | |
| | F 8 | |
| | ⋮ | |
| NEA → | F 8 | |
| | C 0 | NOTE DATA |
| | 6 0 | |
| | 4 1 | |
| | 7 F | |
| | | |
FIG. 9B

METHOD OF STORING AND EDITING PERFORMANCE DATA IN AN AUTOMATIC PERFORMANCE DEVICE

BACKGROUND OF THE INVENTION

The present invention relates generally to automatic performance devices which carry out automatic music performance by reading out performance data prestored in memory, and more particularly to a method for storing and editing performance data in an automatic performance device.

As commonly known, automatic performance devices are such devices which prestore in memory performance information such as pitch, tone generation/tone-deadening timing, etc. for each note of desired music pieces and perform automatic performance by sequentially reading out the prestored performance information to generate tone.

One typical example of various known methods of storing and reproducing the performance information in the automatic performance devices is the so-called "note system", where note data comprised of tone pitch and duration data are stored into memory in accordance with the progress of a music piece, and in subsequent reproduction, each note data is read out when a time represented by preceding tone duration data has passed. This system, however, has a drawback that it can not effectively deal with simultaneous generation of plural tones because each note data is read out after preceding note data is read out. Japanese patent publication No. 4-5996 discloses such an automatic performance device as described above.

A second example is the so-called "event system", where note information comprised of event data and event data generation timing data are prestored in accordance with the progression of a music piece. The event data are classified into the following two types in terms of a manner in which they are stored:

(1) Event data that represents one note by two events, key-on and key-off events and is comprised of key-on and key-off data and data indicative of the pitch of the key; and (2) Event data that represents one note by one event and is comprised of key-on data and data indicative of the pitch of the key and duration.

In addition to the key-on and key-off data, etc., the event data includes other data such as tone color change data, pitch bend data and tempo change data.

Further, the event data generation timing data are classified into the following two types in terms of a manner in which they are stored:

(1) Timing data that represents timing by an absolute time value from the beginning of a music piece or a measure; and (2) Timing data that represents timing by a relative time value between current and preceding event data.

Ordinarily, the timing data is expressed in unit called "clock", and this clock corresponds to a minimum resolution of the timing data. One clock is usually set to 1/24, 1/96, 1/381 or the like of a quarter note. When it is desired to change tempo in the automatic performance devices, it suffices to only adjust the clock frequency.

Moreover, the conventional methods for storing performance information include a real-time recording system which records in real-time performance information generated from an actual performance of an electronic musical instrument, and a step recording system which records performance information by designating the pitch and duration of each note.

For plural-part automatic performance, plural performance tracks are provided in corresponding relations to plural performance parts, and performance information for the individual tracks are read out in parallel independently of each other. Such reading of the performance information for the plural tracks is typically done by time-divisional processing.

In the above-mentioned automatic performance devices, it may sometimes be desired to make editing (modification, addition etc.) on the performance information stored in memory, and in such a case, the editing operation is performed in a manner as shown in FIG. 16. In FIG. 16A, the memory space comprises regions 100, 101 and 102, and it is assumed that music data "A" and "B" as performance information are stored in the regions 100 and 101, respectively, and the region 102 is an empty region C. When it is desired to add music data to locations succeeding a specific address designated by a pointer, a lowest line of the music data B written in the region 101 is written into an address of the empty region 102, and a second line from the lowest line is written into one address preceding the above-mentioned address. Then, by repeating these operations, the entire music data B are copied into the region 102 in a downward shifting fashion. Thus, as shown in FIG. 16B, a predetermined data inserting region D is formed below the music data A, and then, the editing is performed by writing into the data inserting region D music data to be added. By this editing process, the memory space is reformed so as to comprise a region 103 containing the music data A and data inserting region, the region 102 containing the music data B, and a narrowed region 104 corresponding to the empty region C.

However, if the region 101 containing the music data B is large in size, it would take a long time to copy the music data. Further, during the copying of the music data, no other operation can be performed, and hence the long copying time during the editing is not at all preferable to the user.

In addition, unless the size of the data insertion region D is not known in advance, the repetitive music data D sometimes have to be moved after having been copied, and this would require an even longer copying time.

SUMMARY OF THE INVENTION

It is therefore an object of the present invention to provide a method of storing and editing performance data, which allows editing operations such as data insertion, data deletion and the like to be performed within a short time.

In order to accomplish the above-mentioned object, the present invention provides a method of storing and editing performance data in an automatic performance device provided with a memory for storing the performance data, the method comprising the steps of dividing a memory space of the memory into a plurality of blocks each having a predetermined storage capacity, and storing performance data into a memory block chain which is composed of any one or more the blocks connected together in arbitrary order, providing a management table for storing management information for, in accordance with order of a performance, specifying the one or more blocks composing the memory block chain, when a data-inserting editing is to be performed on the performance data, securing any of the blocks available in the memory as an additional block and copying into the additional block the performance data stored in a region of a specific one of the blocks which corresponds to a desired inserting position and which succeeds the desired inserting position, to thereby create available storage locations in the specific block and the additional block for permitting writing of desired data to be inserted, and rewriting the management information stored in the management table in such a manner that the additional block is connected next to the specific block in the memory block chain.

According to the present invention, a series of the performance data is stored in one or more blocks composing a memory block chain of the memory. Because the performance order of the one or more blocks composing the memory block chain is specified by management information stored in the management table, the one or more blocks need not have storage locations arranged in a physically successive fashion within the memory; the storage locations of the blocks may be arranged in arbitrary order. When a data-inserting editing is to be performed, any of the blocks available in the memory is secured as an additional block, and the management information stored in the management table is rewritten in such a manner that the additional block is connected next to a specific block corresponding to a desired inserting position in the memory block chain. At the same time, the performance data having been stored in the specific block corresponding to the desired inserting position is divided into a preceding data group before the inserting position and into a succeeding data group after the inserting position, and the succeeding data group is copied into the additional block. In this way, a region of the specific block which succeeds the inserting position becomes available storage locations, and a region of the additional block which precedes the storage locations for the succeeding data group also becomes available storage locations. Thus, available storage locations which together correspond in size exactly to a single block are created in the specific and additional blocks, and data to be inserted can be written in these available storage locations.

As may be apparent from the foregoing, it is possible to prevent data of other blocks composing the memory block chain from being rewritten during the data-inserting editing operation. Consequently, the present invention does not require a long processing time for data transfer and switching (exchange) as was necessary in the prior art, and can perform the data-inserting editing operation within a very short time.

Further, the present invention may also be arranged in such a manner that predetermined non-processing data are stored at the available storage locations created in the specific block and additional block so that the non-processing data remains stored in such storage location where no data to be inserted has not been written. Reading of the non-processing data is skipped while the memory is read for reproduction of the performance data. Consequently, when reproductively sounding the performance data to aurally confirm the edited contents during the data-inserting editing operation, reading of unnecessary non-processing data is skipped, and thus reproductive generation of tone can be achieved with no trouble.

In the case of data deletion, the non-processing data may also be stored in place of the deleted data, which eliminates the need for performing, during the data-deleting editing operation, data transfer or data switching in order to bring the performance data forward to data-deleted storage locations for storage therein. Accordingly, in this case as well, the present invention does not require a long processing time for data transfer and switching as was necessary in the prior art, and can perform the data-deleting editing operation within a very short time.

Since each of the non-processing data is skipped during reproduction as mentioned and presents no substantial trouble, it may remain stored in the memory. However, for efficient use of the memory, the non-processing data may of course be deleted to reform the storage arrangement of the performance data when time required for data transfer or data switching is no problem to the user. For example, it may be sufficient that upon completion of the editing, such deletion of the non-processing data and rearrangement of the performance data (transfer or switching) are performed automatically.

Now, the preferred embodiment of the present invention will be described in detail below with reference to the accompanying drawings.

BRIEF DESCRIPTION OF THE DRAWINGS

In the accompanying drawings:

FIG. 2 is a diagram illustrating the contents of a song table;

FIG. 3 is a diagram illustrating the contents of a file allocation table;

FIGS. 4A and 4B illustrate the structure of a memory block chain and the actual structure of memory, respectively;

FIGS. 5A, 5B and 5C jointly illustrate an editing operation performed in accordance with the present invention;

FIG. 8A shows a picture displayed during editing;

FIG. 8B shows an example of performance data corresponding to the displayed picture of FIG. 8A;

FIG. 9A shows a displayed picture after editing;

FIG. 9B shows an example of performance data corresponding to the displayed picture of FIG. 9A;

DETAILED DESCRIPTION OF THE PREFERRED EMBODIMENT

Figure 1:
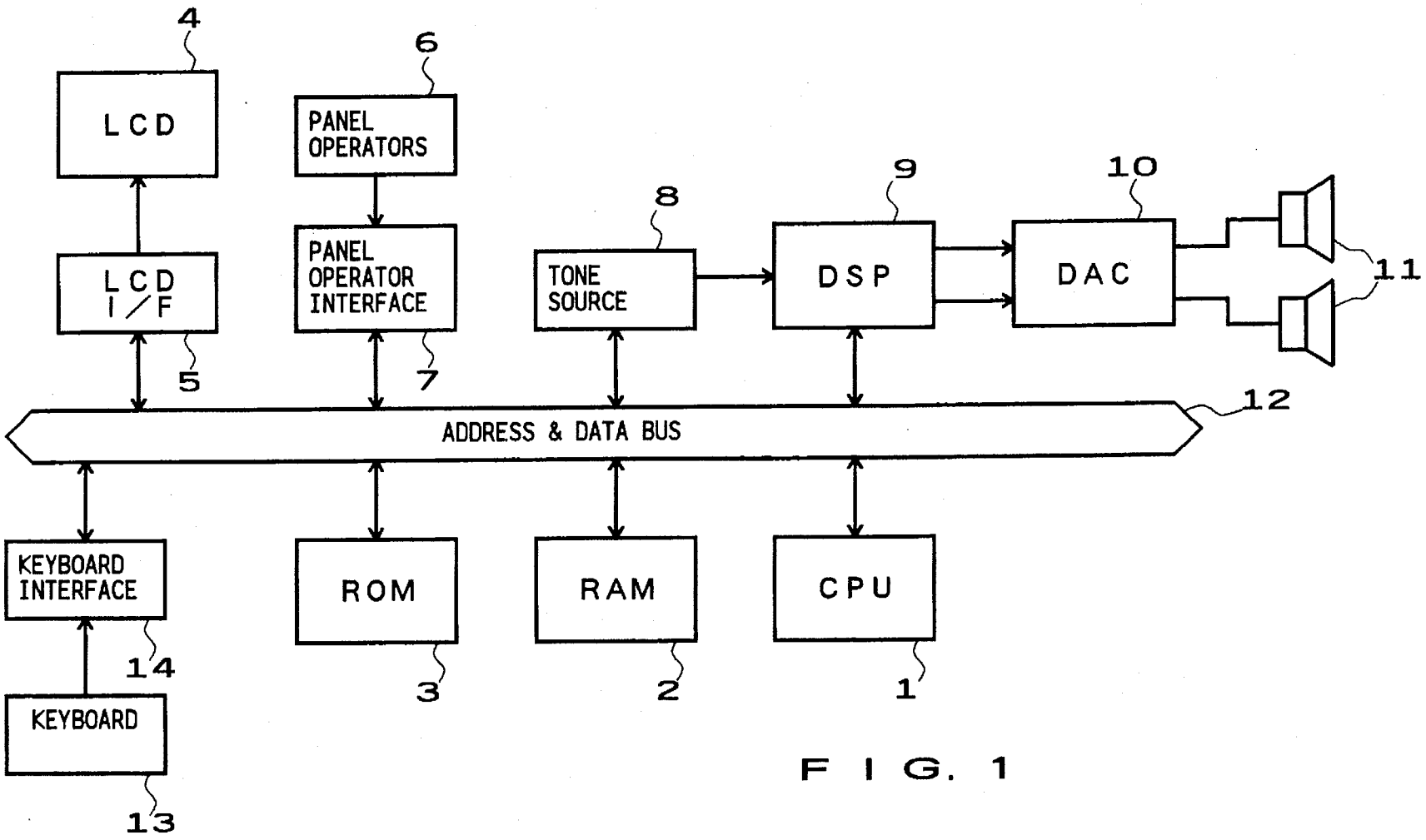
FIG. 1 is a block diagram illustrating the general hardware structure of an automatic performance device embodying the present invention.

In FIG. 1, there is illustrated the general hardware structure of an automatic performance device embodying the present invention.

In the figure, a CPU (Central Processing Unit) 1, which is connected to an address and data bus 12, controls various components of the device on the basis of programs stored in a ROM (Read Only Memory) 3. To execute an automatic performance, the CPU 1 reads out prestored performance data from a RAM (Random Access Memory) 2 and sends key-on data and tone color data to a tone source 8 via the address and data bus 12, so that the tone source 8 generates tone waveform signal. This tone waveform signal is then sent to a DSP (Digital Signal Processor) 9, where the signal is imparted a desired effect such as reverberation. Subsequently, the tone waveform signal is converted into analog signal by means of a digital-to-analog (A/D) converter 10 and then audibly reproduced or sounded via speakers 11. Here, the sounding of the tone waveform signal may be in a selected one from a plurality of tone colors preset in the ROM 3, or in a tone color stored in the RAM 2 as desired by the user.

Operators 6 on an operation panel (panel operators) are connected to the address and data bus 12 via a panel operator interface 7, to allow the user to set desired tone colors. The setting operation of the tone colors may be done by the user while watching a picture displayed on a liquid crystal display (LCD) 4 that is connected to the address and data bus 12 via a display interface 5. Further, performance data to be stored in the RAM 2 are entered via unillustrated operators.

A keyboard 13 may be provided so that manual performance can be made on the keyboard 13 in addition to automatic performance and that real-time performance data resultant from operation on the keyboard 13 are stored into the RAM 2. This keyboard 13 is connected to the address and data bus 12 via a keyboard interface 14.

FIG. 2 illustrates the contents or structure of a "song" table used in the automatic performance device. In this song table, the row represents plural performance parts which are shown in this example as tracks "Tr1", "Tr2", "Tr3", . . . , "Chord" and "Style", and the column represents music piece numbers which are shown in this example as "Song 1", "Song 2", . . . , "Song 20". In this table is stored the head block number of a performance data memory in which performance data for music pieces are written. The block number will be later described in detail, and in the illustrated example, block number "00" is stored only in track 2 of Song 1. "FE" indicates empty data.

As shown in FIG. 4B, the performance data memory is divided into a plurality of 128-byte blocks, to which serial numbers "00" to "99" are respectively allocated. Namely, the performance memory is comprised of 100 blocks beginning with block "00" and ending with block "99", and each set of the performance data for a music piece is written in plural blocks using each block as a data storage unit. Because each set of the performance data is written while searching for a necessary number of available or empty blocks, it often may not be written in the serially-numbered blocks. For this reason, a file allocation table is provided which manages the block numbers so as to arrange the blocks storing performance data of a music piece, in conformity with the sequence of the performance data.

The contents of the file allocation table is shown by way of example in FIG. 3, in which file allocation data are written in respective blocks indicated by serial block numbers "00" to "99". The file allocation data for each block designates the block number of a block that is to be connected next to that block. In the example of FIG. 3, block number "00" is set as the head block because head block number "00" is designated in the song table of FIG. 2 as mentioned earlier. Block "03" is set to be connected next to the head block "00" because the file allocation data in block "00" designates "03", and block "05" is set to be connected next to block "03" because the file allocation data in block "03" designates "05". Similarly, block "01" is set to be connected next to block "05" because the file allocation data in block "05" designates "01". The file allocation data in block "01" is "FF" which instructs the end of the performance data. Namely, the file allocation data "FF" signifies an end block. Further, file allocation data "FE" signifies an empty block.

A plurality of the blocks storing performance data for one music piece which have been connected in accordance with the sequence of performance as mentioned above will hereinafter be referred to as a "memory block chain". Thus, the memory block chain of FIG. 3 will be formed of blocks "00", "03", "05" and "01" as shown in FIG. 4A.

Next, a description will be given on an example where new performance data is inserted between the performance data having been written in the memory block chain.

First of all, as shown in FIG. 5A, a pointer is caused to point to a location immediately before an address location at which the new data is to be inserted. In the illustrated example of FIG. 5A, the pointer is set in block "03", data written before the pointer position is represented by "E", and data written after the pointer position is represented by "F". Then, an empty block is searched. If, for example, the empty block thus searched out is block "02", the data in block "03" now being pointed to by the pointer is copied into block "02". After that, NOP (Non-processing) data ("F8") that causes no processing to be performed are written at addresses in a "G" data region corresponding to data "E" and at addresses of an "F" region of block "03".

In this way, block "02" is newly added to the memory block chain to connect to block "03", and hence the memory block chain at this time is formed in such a manner that block "02" is inserted between block "03" and block "05" as shown in FIG. 5B. Namely, the "F" data region of block "03" and "G" data region of block "02" where the NOP data have been written are combined to jointly provide data region "H", and thus data F' copied into block "02" is placed to connect to data "H". Further, since this data region H are occupied by the NOP data, performance data can be newly written into this region. As mentioned above, to insert performance data during the editing, a NOP data region is created immediately after the pointer position so as to allow data to be written therein.

This approach requires data coping of only block and hence can reduce the necessary editing time to a greater degree.

Figure 6:
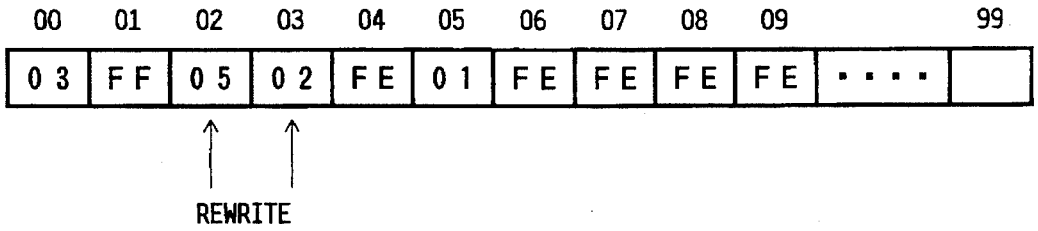
FIG. 6 is a diagram illustrating the contents of the file allocation table after having been rewritten.

FIG. 5C illustrates the detail of data regions "E" and "H", and in this example, last data in the "E" data region is "98" and a pointer points to this data. Data succeeding the address pointed to by the pointer are data "H" where the NOP data "F8" have been written. By the insertion of block "02" in the memory chain, the file allocation table has now been rewritten as shown in FIG. 6. Namely, the data in block "02" has been rewritten from "FE" to "05", and the data in block "03" has been rewritten from "05" to "02".

Figures 7A, 7B:
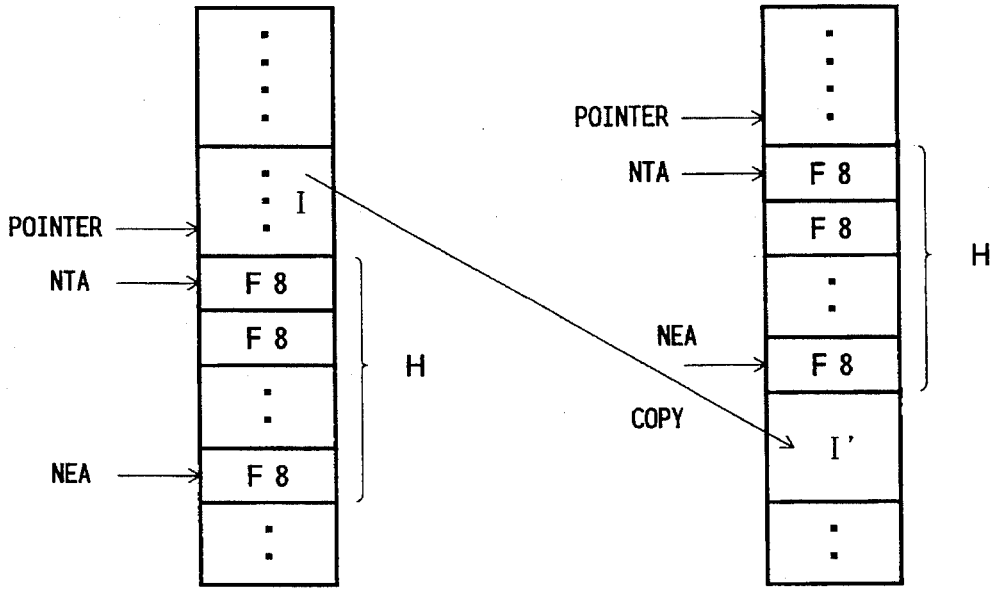
FIGS. 7A and 7B jointly illustrate another editing operation performed in accordance with the present invention.
Figures 16A, 16B:
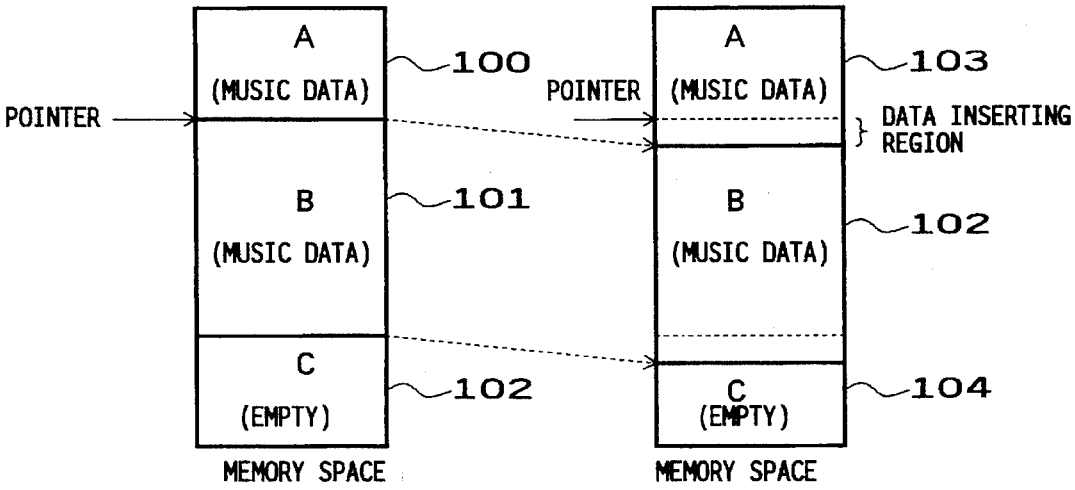
FIGS. 16A and 16B jointly illustrate an editing operation performed in the prior art.

In order to change the edited position during an editing operation while moving the pointer position, the NOP data are also moved in correspondence to the pointer movement. More specifically, when the pointer pointing to a region of data "I" as shown in FIG. 7A is moved to an address location above the data "I" as shown in FIG. 7B, the NOP data F8 in data "H" are moved to be positioned immediately after the pointer as shown in FIG. 7B. Thus, data "I" are copied into the data F8 region to become data I', after which NOP data F8 are written into the region of data I to thereby move data H.

In the illustrated example, "NTA" (NOP Top Address) is the head address of the NOP data, and "NEA" (NOP End Address) is the end address of the NOP data.

FIG. 8A shows an editing picture that is displayed on the liquid crystal display 4 shown in FIG. 1. In this editing picture, notes are shown on stave, and a pointer is shown by an arrow. This pointer is movable step by step, each step being 1/96 of the length of a quarter note, for example. Namely, in this case, a quarter note is represented by a 96-clock length. Performance data indicated by the picture of FIG. 8A are shown in FIG. 8B. In the performance data, one note is expressed by five data successively arranged in the vertical direction, of which first data "CO" is key-on data, second data "60" represents a gate time (since data "60" is in hexadecimal representation, this data represents 96 clocks), next data "40" represents a note number, next data "7F" represents a velocity, and last data "E0" represents duration.

The velocity data indicates a key operation velocity, but the velocity data in this example is tone volume data since tone volume change in accordance with the key velocity. The duration data indicates a time length between the current note and the next note, and the MSB (Most Significant Bit) of its first line is compulsorily made "1" so as to distinguish from the gate time. Thus, data "E0" will indicate a 96-clock length. Further, as shown, the pointer normally points to the duration data.

FIG. 9B shows edited note data in the case where, as shown in FIG. 9A, an eighth note of note name "A" is inserted between the two notes displayed in the picture of FIG. 8A. Since an eighth note is inserted between quarter notes in the 9A example, the duration data indicating an inter-note time length before the insertion are caused to change. Thus, the duration data at an address location designated by the pointer changes from data "E0" to data "B0" indicating a half of the length, i.e., 48 clocks. The inserted eighth note data is comprised of data "CO" indicative of a key tone, data "48" indicative of a 48-clock gate time, data "45" indicative of a note number, data "7F" indicative of a velocity, and data "B0" indicative of duration. This duration data indicates a time length between the inserted eighth note and the second quarter note data, and hence it is 48-clock duration data.

It should be noted that the NOP data remain even after the eighth note is inserted, but performance can be started upon termination of the editing operation since the NOP data are ignored in an automatic performance play routine.

Figure 10:
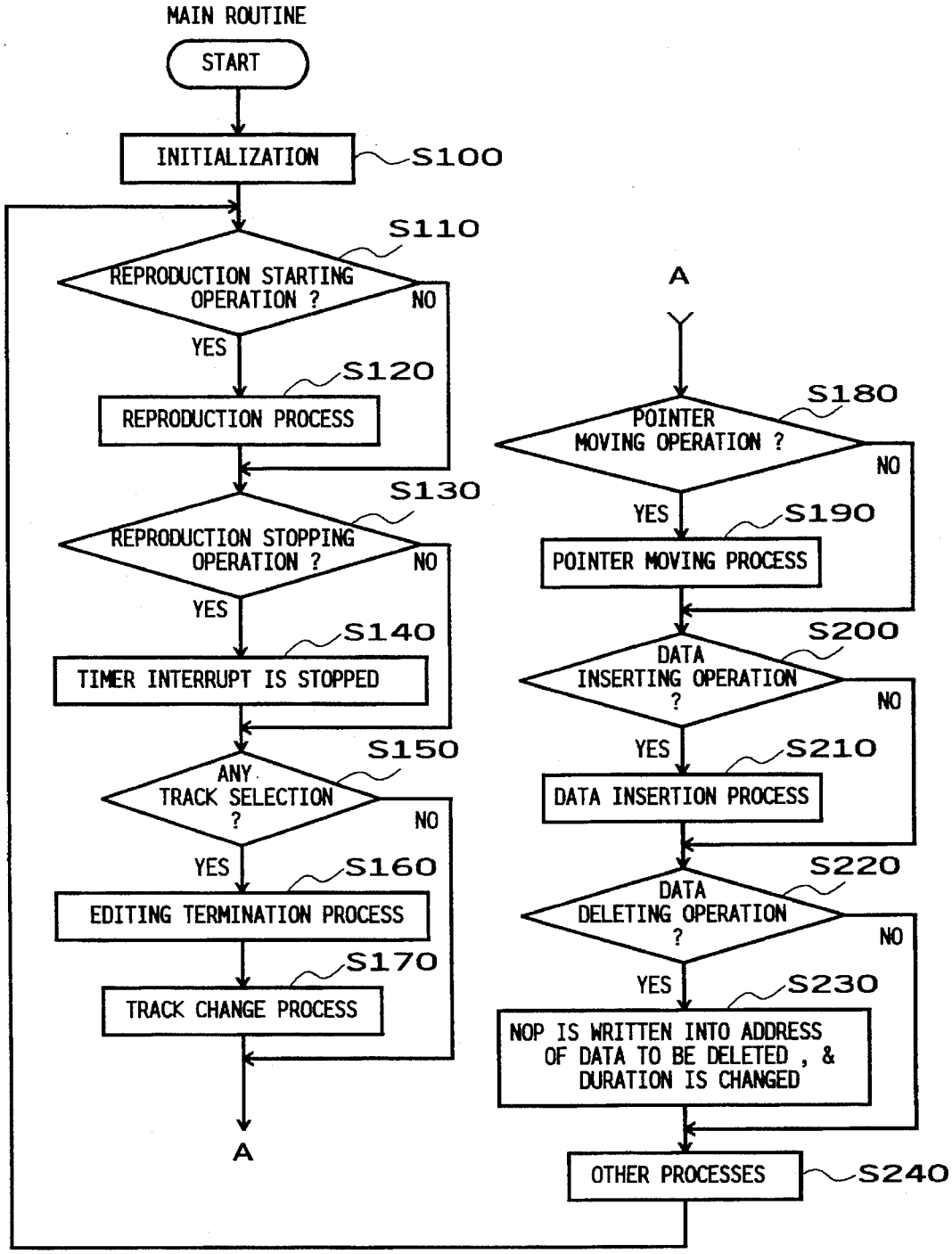
FIG. 10 is a flowchart of a main routine.

FIG. 10 is a flowchart of a main routine carried out in the automatic performance device.

First, in step S100, an initialization operation is executed to clear the contents of various memories, etc. After the initialization, it is checked in step S110 whether a start switch on the operation panel has been operated by the user or not. If answered in the affirmative in step S110, a reproduction process is performed in next step S120 as will be described later. Then, as in the case where the start switch has not been operated, it is checked in step S130 whether a reproduction stop switch on the operation panel has been operated. If the reproduction termination switch has been operated as determined in step S130, the program goes to step S140 where a later-described timer interrupt process is terminated to stop the play routine. Namely, a predetermined termination process is carried out to allow the automatic performance device to edit. Then, as in the case where the reproduction stop switch has not been operated as determined in step S130, the program proceeds to step S150. In step S150, it is determined whether an operation has been made to select any of the tracks of FIG. 2 that is to be edited. If answered in the affirmative in step S150, an editing termination process is performed, in step S160, on any of the tracks having so far been edited. After that, the program proceeds to step S170, where a track change process is performed to display data about the selected track, etc.

Next, as in the case where no track selecting operation has not been detected in step S150, the program goes to step S180 so as to determine whether a pointer moving operation has been made. With a determination of YES in step S180, the program proceeds to step S190, where a pointer moving process is performed to display on the screen such data before and after the moved pointer, etc. Then, as in the case where no pointer moving operation has been made, it is determined in step S200 whether a data inserting operation has been made. If such a data inserting operation has been performed as determined in step S200, a data insertion process is performed. Further, as in the case where no data inserting operation has not been made, it is determined in step S220 whether a data deleting operation has been made. With an affirmative determination in step S220, NOP data is written at each address of data to be deleted.

Further, because deletion of the note causes a change in the duration between notes immediately before and after the deleted note, the duration data is changed accordingly. After that, as in the case where no data deleting operation is made, the program goes to step S240 so as to perform other processes not associated with automatic performance and thereafter reverts to step S110 to repeat the above-mentioned processes.

Next, the reproduction process of step S120 of the main routine will be described in greater detail with reference to FIG. 11. This reproduction process is triggered only when the start switch has been operated.

The reproduction process accepts a timer interrupt to permit a timer interrupt process in step S300. Then, in step S310, data is read out from a location designated by the pointer. At this time, the pointer is at the beginning of the music data because it is a start point. It is then determined in step S320 whether the data read out in step S310 is duration data. Since the music data is arranged in a manner as shown in FIGS. 8 and 9 where the head data of the music data is not duration data, the program goes to step S330 to further determine whether the read-out data is NOP data. If the read-out data is not NOP data as determined in step S330, process corresponding to an event (event-correspondent process) is performed; for example, if the read out data is key-on data, a tone generation process is performed to generate tone via the speakers 11 shown in FIG. 1.

Then, as in the case where the read-out data is NOP data, the pointer is moved by one unit in step S350 to point to an address of next data, and the program reverts to step S300 to repeat the above-mentioned operations. Once duration data has been read out in step S320, the program branches to step S360 in order to set the duration data into a counter COUNT and then returns to the main routine.

Figure 12:
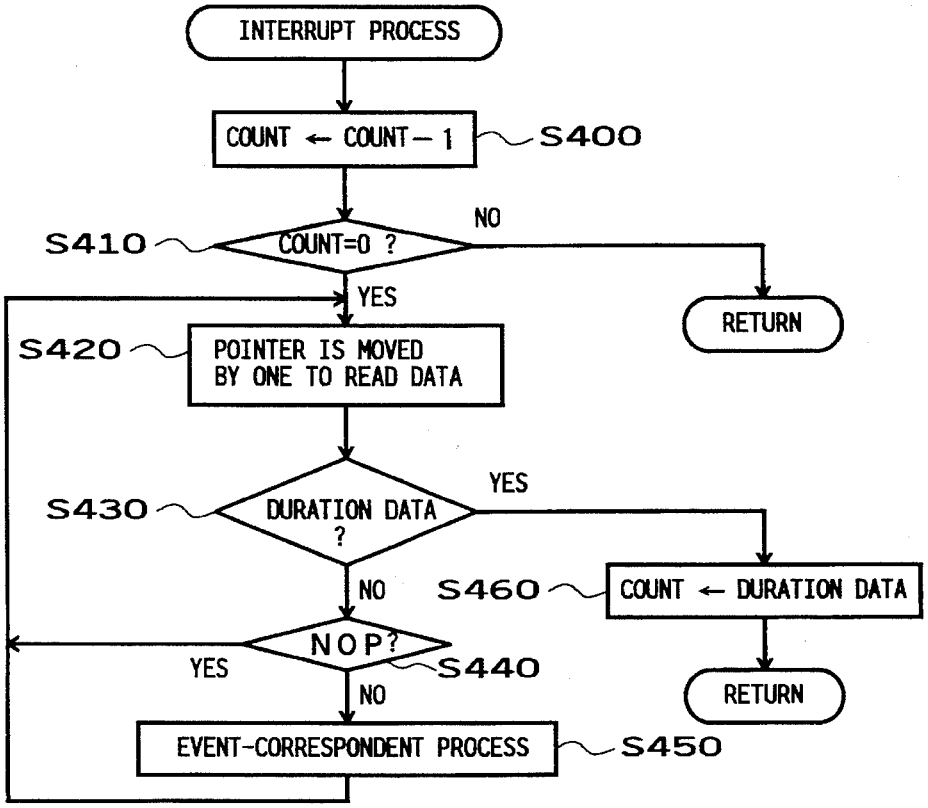
FIG. 12 is a flowchart of an interrupt process.

FIG. 12 is a flowchart of the interrupt process which is triggered by an interrupt signal from the CPU 1 of Fig. 1.

Upon receipt of the interrupt signal, the value of the counter COUNT having set therein the duration data is decremented by one, and it is then examined in step S410 whether the count value of the counter COUNT has become "0". If the count value has become "0", this means that the time represented by the duration data has lapsed, the pointer is moved by one unit to read out data in step S420. A determination is then made in step S430 as to whether the data read out in step S420 is duration data. With a negative determination in step S430, the program proceeds to step S440 to further determine whether the read-out data is NOP data. If the read-out data is not NOP data as determined in step S440, process corresponding to an event (event-correspondent process) is performed; for example, if the read-out data is key-on data, the tone generation process is performed to generate tone via the speakers 11 shown in FIG. 1.

After that, as in the case where step S420 determines that the read-out data is NOP data, the program reverts to step S420 in order to move the pointer by one unit so that the pointer points to an address of next data. Then, the data at the address pointed to by the pointer is read out, and the above-mentioned operations are repeated. Once duration data has been read out in step S420, the program branches, in step S430, to step S460 in order to set the duration data into the counter COUNT and then returns to the main routine.

If step S410 determines that the count value of the counter COUNT is not "0", this means that the time represented by the duration data has not yet lapsed, the program returns to the main routine. Since the interrupt frequency corresponds to the performance tempo, the tempo can be varied by changing the timer clock frequency so as to change the interrupt frequency.

Figure 11:
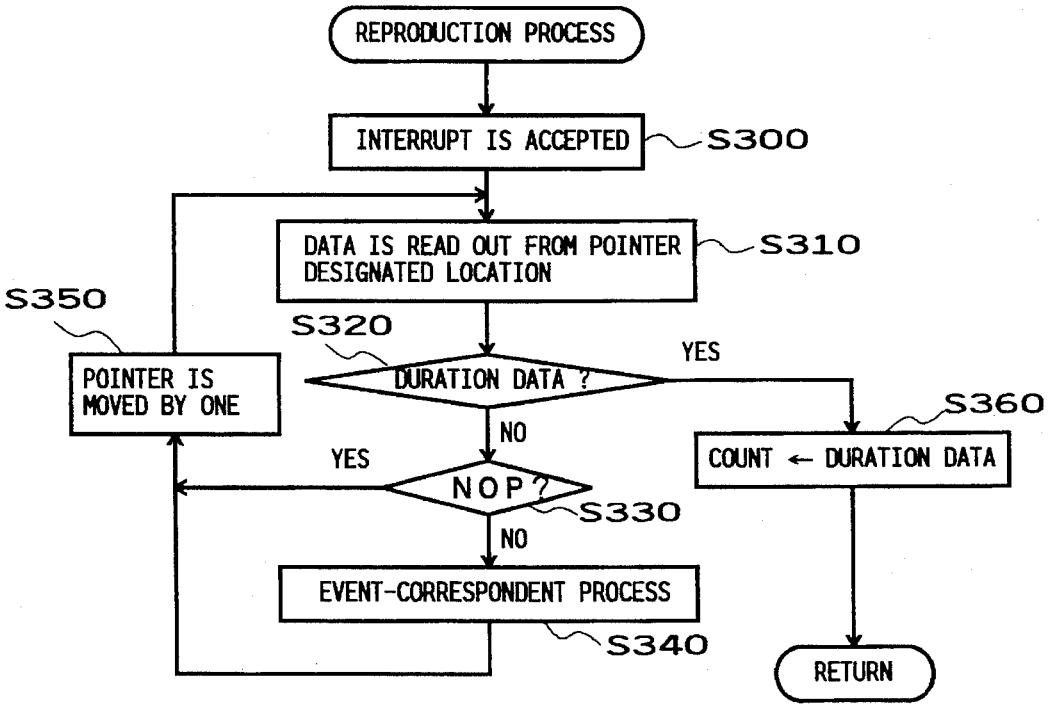
FIG. 11 is flow chart of a reproduction process.

As shown in FIGS. 11 and 12, if the read-out data is NOP data, the pointer is sequentially incremented with no process being performed. It is possible that the NOP data continues over approximately 128 bytes, but almost no adverse effects such as a delay in tone generation are produced on the reproduction operation (Although this depends on the processing speed of the CPU used, there may be no substantial problems with the CPUs generally employed in the present-day automatic performance devices).

Figure 13:
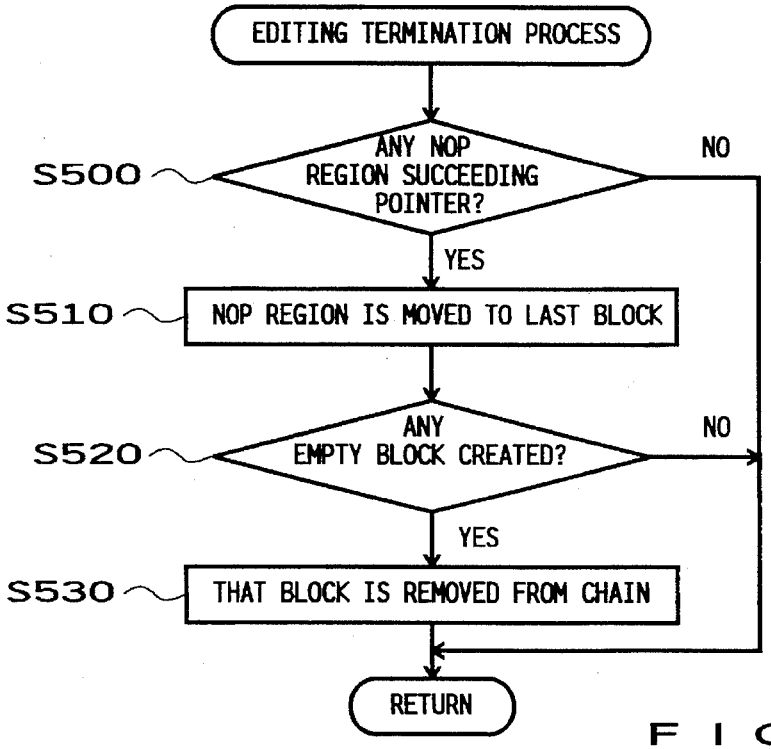
FIG. 13 is a flowchart of an editing termination process.

FIG. 13 is a flowchart of the editing termination process which is triggered when a track selecting operation has been made as mentioned.

First, in step S500, a determination is made as to whether there is any NOP data region succeeding the location designated by the pointer. With an affirmative determination in step S500, the NOP data is moved, in step S510, to the last block of the memory block chain. Further, in step S520, it is determined whether the movement of the NOP data has created any block entirely occupied by the NOP data (empty block). If such an empty block has been created, then that block is removed from the memory block chain in step S530; that is, the file allocation table is rewritten. Then, the program returns to the main routine as in the case where step S500 determines that no NOP data region is present succeeding the pointer and the case where step S520 detects that no empty block has been created.

Figure 14:
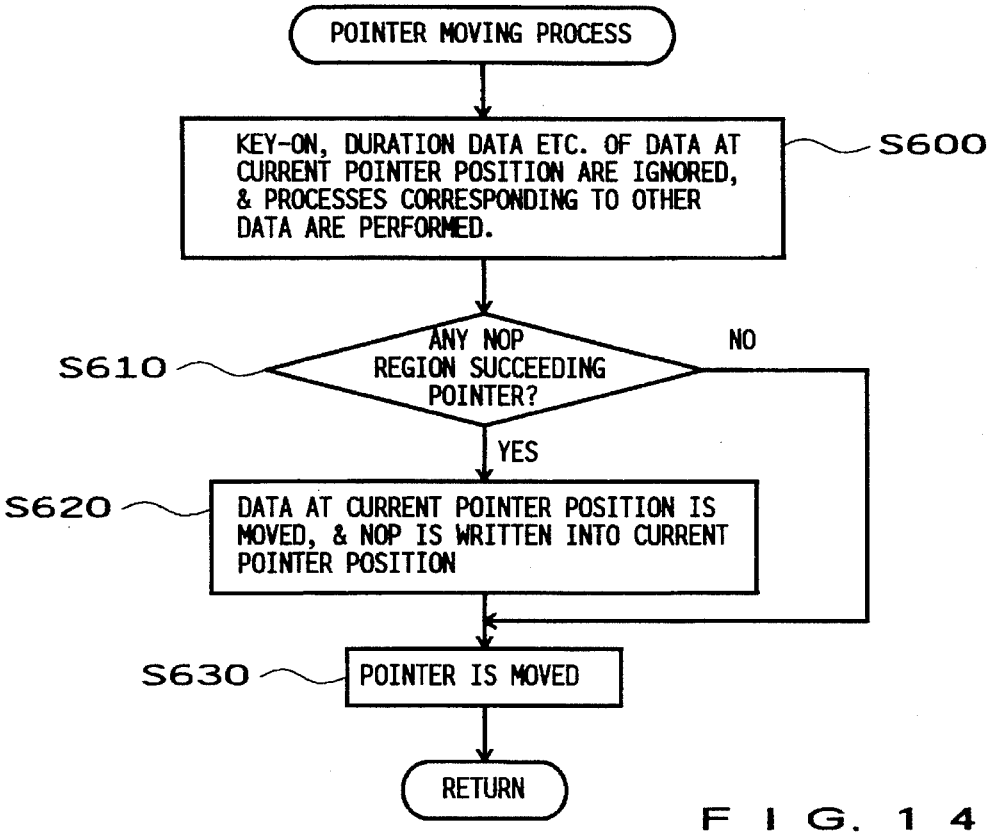
FIG. 14 is a flowchart of a pointer moving process.

FIG. 14 is a flow chart of the pointer moving process, where the reproduction is caused to stop if there is any data to be modified during the reproduction, and the pointer is moved to point to an address of the data so as to modify that data. In this case, the pointers in all the tracks are similarly moved so that the tracks are synchronized with each other even when the reproduction is started immediately.

In step S600, this pointer termination process ignores key-on, duration data etc. of the data at the current pointer location and performs processes corresponding to the other data. This is because the key-on and duration data can be ignored because no tone is generated while the pointer is moved, but if the other data containing data for changing programs such as for changing tone color, effect etc. are ignored, tone will not be generated in preset tone color, etc. when the reproduction is started at the pointer location.

Next, in step S610, it is determined whether there is any NOP data region succeeding the pointer location. With an affirmative determination in step step S610, the program proceeds to step S620 to move the data at the pointer location and write NOP data into the location currently designated by the pointer. Then, the pointer is moved by one unit in step S630, and the program returns to the main routine. Similarly, if there is no NOP data as determined in step S630, the pointer is moved by one unit in step S630, and the program returns to the main routine. These steps S620 and S630 are directed to moving the data I of FIG. 7. The last line of the data I pointed to by the pointer is copied into the NEA location of the NOP data, and data "F8" is written into the last line of the data I. Then, the pointer is moved upwardly by one unit to thereby repeat the above-mentioned operations, so that the data I is successively moved as shown in FIG. 7B. Thus, the data I can be moved, and the NOP data can be moved after the pointer.

Figure 15:
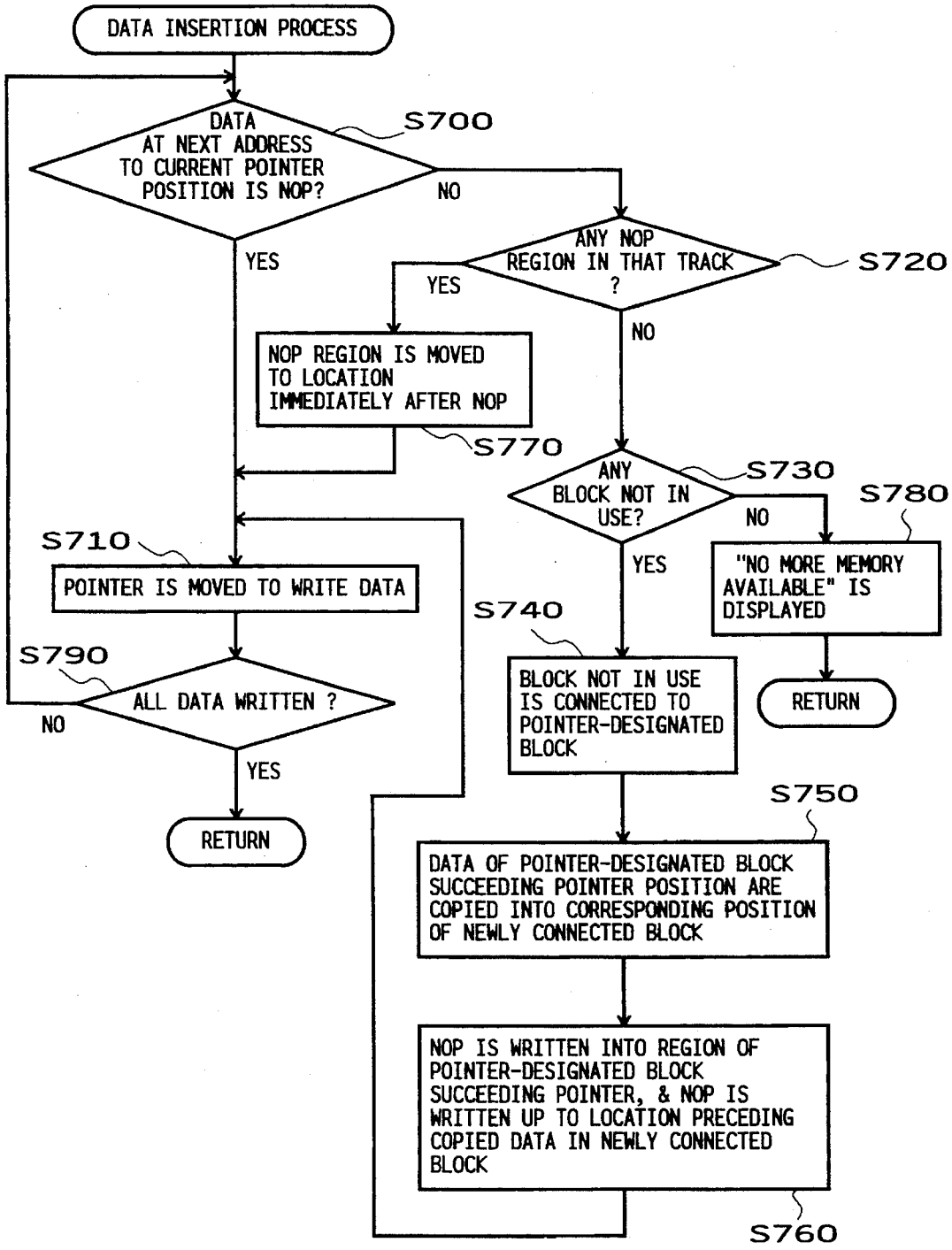
FIG. 15 is a flowchart of a data insertion process.

FIG. 15 is a flowchart of the data insertion process.

In step S700, it is determined whether data at an address next to the current pointer location is NOP data. If the data at the next address is NOP data, the pointer is moved, in step S710, to write data at the next address. It is further determined in step S790 whether all data to be written have been written. If the user has instructed that there is still other data to be written, the program reverts to step S700 to repeat the above-mentioned data write operation. If the user has instructed that all the data have been written, the program returns to the main routine.

If, however, the data at the next address is not NOP data as determined in step S700, it is further determined in step S720 whether there is any NOP data in the track in question. With a determination of YES in step S720, the region of the NOP data is moved, in step S770, to a location immediately after the pointer, and the program proceeds to step S710, where, as mentioned earlier, the pointer is moved to write data into the designated location. It is then further determined in step S790 whether all data to be written have been written. If the user has instructed that there is still other data to be written, the program reverts to step S700 to repeat the above-mentioned data write operation. If, however, the user has instructed that all the data have been written, the program returns to the main routine.

If there is no NOP data region as determined in step S720, a search is made, in step S730, for a block currently not in use, i.e., empty block. With an affirmative determination in step S730, the searched-out empty block is connected, in step S740, to a block designated by the pointer. In this manner, the memory block chain is reformed as shown in the FIG. 5B example where block "02" is inserted. Then, in step S750, data of the pointer-designated block succeeding the pointer location is copied into a corresponding location of the newly connected block. Namely, copying as shown in FIG. 5A is performed. Further, in step S760, NOP data are written into the region of the pointer-designated block succeeding the pointer location and up to the region preceding the copied data in the newly connected block. In this way, NOP data are written into the data H(F+G) of FIG. 5B.

After that, the pointer is moved, in step S710, to write data at the next address as earlier mentioned. It is then further determined in step S790 whether all data to be written have been written. If the user has instructed that there is still other data to be written, the program reverts to step S700 to repeat the above-mentioned data write operation. If, however, the user has instructed that all the data have been written, the program returns to the main routine. In the event that there is no empty block as determined in step S730, a statement "no more memory available" is displayed on the display in step S780, and then the program returns to the main routine.

In order to allow the plural tracks to be synchronized with each other, the individual pointers of the plural tracks are conditioned to simultaneously move during the editing operation as well as during the performance operation.

Although, in the above-described embodiment, the pointer is placed immediately before an address where data is to be inserted, the pointer may just be placed at an address where data is to be inserted.

According to the embodiment of the present invention, the pointer position is the same for both the performance operation and the editing operation, and hence the editing operation can be started at the same place where the reproduction is stopped and the reproduction can be started at the same place where the editing is performed. This allows the edited contents to be confirmed immediately.

With the features so far described, the present invention can create a data inserting region within a very short time and hence greatly reduce the time required for the editing operation.

What is claimed is:

1. A method of storing and editing performance data in an automatic performance device provided with a memory for storing the performance data, said method comprising the steps of:

dividing a memory space of said memory into a plurality of blocks each having a predetermined storage capacity, and storing performance data into a memory block chain which is composed of any one or more said blocks connected together in arbitrary order;

providing a management table for storing management information for, in accordance with order of a performance, specifying said one or more blocks composing said memory block chain;

when a data-inserting editing is to be performed on the performance data, securing any of said blocks available in said memory as an additional block and copying into said additional block the performance data stored in a region of a specific one of said blocks which corresponds to a desired inserting position and which succeeds said desired inserting position, to thereby create available storage locations in said specific block and said additional block for permitting writing of desired data to be inserted; and rewriting the management information stored in said management table in such a manner that said additional block is connected next to said specific block in said memory block chain.

2. A method as defined in claim 1 which further comprises the step of writing desired data to be inserted, into a particular region of said specific block succeeding said inserting position, said particular region being said available storage locations in said specific block.

3. A method as defined in claim 2 which further comprises the step of writing other desired data to be inserted, into a particular region of said additional block preceding said region of said additional block storing therein the copied data, said particular region of the additional block being said available storage locations created in said additional block.

4. A method as defined in claim 1 wherein said management table has a storage section for each of said blocks, and said storage section for each of said blocks stores therein a number indicative of one of said blocks that is to be connected next to the block corresponding to said storage section.

5. A method as defined in claim 1 wherein said memory is capable of storing performance data for a plurality of music pieces in such a manner that the performance data for each said music piece is stored in a separate said memory block chain, and wherein a head block management table is further provided for storing information indicating a head block of the memory block chain for each music piece.

6. A method as defined in claim 1 wherein said memory is capable of storing performance data corresponding to a plurality of tracks for a single music pieces in such a manner that the performance data for each said track is stored in a different said memory block chain, and wherein a head block management table is further provided for storing information indicating a head block of the memory block chain for each said track.

7. A method as defined in claim 1 wherein each of said blocks has a same memory size amounting to a predetermined number of bytes.

8. A method as defined in claim 1 which further comprises the steps of:

writing predetermined non-processing data into said available storage locations of said specific and additional blocks; and writing desired data to be inserted, into said storage locations storing therein said non-processing data in place of said non-processing data.

9. A method as defined in claim 8 which further comprises the step of writing said non-processing data into a particular region of said specific block succeeding said inserting position and into a particular region of said additional block preceding said region storing the copied data, said particular regions of said specific and additional blocks being said available storage locations.

10. A method as defined in claim 8 which further comprises the step of, when the inserting position in which data is to be inserted has been changed, switching the storage locations for a part of already stored performance data and for the non-processing data with each other, in such a manner that the non-processing data is set in the storage locations corresponding to a resultant new inserting position.

11. A method as defined in claim 8 wherein, when the storage locations in said specific block and said additional block storing therein the non-processing data have run out during the data-inserting editing, repeating said step of securing any of said blocks available in said memory as an additional block and copying into said additional block the performance data and said step of rewriting the management information, in order to create another additional block to continue the data-inserting editing.

12. A method as defined in claim 8 which further comprises the step of, upon completion of the editing, switching the non-processing data and the performance data succeeding the non-processing data with each other, in such a manner that said non-processing data is moved to an end of the performance data in a last said block of said memory block chain.

13. A method as defined in claim 12 which further comprises the step of, when the performance data has run out in the last block as a result of switching the non-processing data and the performance data succeeding the non-processing data, rewriting the management information of said management table in such a manner that the last block is removed from said memory block chain.

14. A method as defined in claim 8 which further comprises the step of, in reading said memory to reproduce the performance data, skipping each said storage location storing the non-processing data.

15. A method of storing and editing performance data in an automatic performance device provided with a memory for storing the performance data, said method comprising the steps of:

dividing a memory space of said memory into a plurality of blocks each having a predetermined storage capacity, and storing performance data into a memory block chain which is composed of any one or more said blocks connected together in arbitrary order;

providing a management table for storing management information for, in accordance with order of a performance, specifying said one or more blocks composing said memory block chain storing therein the performance data;

securing any of said blocks available in said memory as an additional block, in order to perform a data-inserting editing;

rewriting the management information stored in said management table in such a manner that said additional block is connected next to a specific one of said blocks which corresponds to a desired data inserting position in said memory block chain; and dividing data stored in said specific block at the desired inserting position and inserting desired data between the divided data, to thereby execute data rewrite for data-inserting editing between said specific block and said additional block.

16. A method as defined in claim 15 which further comprises the step of storing predetermined non-processing code into address regions of said specific block and additional block in which no performance data is stored, so that said address regions storing therein the non-processing code are skipped during reproduction of the performance data.

17. A method of storing and editing performance data in an automatic performance device including a memory for storing the performance data, said method comprising the steps of:

dividing a memory space of said memory into a plurality of blocks each having a predetermined storage capacity, and storing performance data into a memory block chain which is composed of any one or more said blocks connected together in arbitrary order;

providing a management table for storing management information for, in accordance with order of performance, specifying said one or more blocks composing said memory block chain storing therein the performance data; and when a part of the performance data stored in said memory block chain is to be deleted, removing the part of the performance data from an address region in any of the blocks where the part of the performance data resides, and writing predetermined non-processing code into said address region in place of the removed part of the performance data, so that said address region storing therein the non-processing code is skipped during reproduction of the performance data.

18. A system for managing storage and editing of performance data comprising:

performance data memory means including a plurality of blocks each having a predetermined storage capacity, and storing a series of performance data in a memory block chain which is composed of any one or more said blocks connected together in arbitrary order;

management table means for storing management information for, in accordance with order of a performance, specifying said one or more blocks composing said memory block chain in which the series of performance data is stored;

edit instruction means for instructing insertion or deletion of data into or from the series of performance data stored in said performance data memory means; and control means for, in accordance with a data insertion instruction from said edit instruction means, adding any of the blocks available in said performance data memory means to said memory block chain and rewriting the management information stored in said management table means.

19. A system as defined in claim 18 which further comprises insertion processing means for dividing the data stored in a specific one of said blocks in said memory block chain which corresponds to the desired inserting position, into a preceding data group and a succeeding data group at a desired inserting position, moving said succeeding data group to said added block with said preceding data group left in said specific block so as to create available storage locations in said specific block and said added block, and writing desired data to be inserted, into said available storage locations created in said specific block and said added block.

20. A system as defined in claim 18 which further comprises means for storing predetermined non-processing data into any of the available storage locations in said specific block and said added block where no performance data is written, in such manner that the storage location storing therein the non-processing code is skipped during reproductive readout of the performance data.

* * * * *